United States Patent [19]

Reeves

[11] Patent Number: 5,029,390

[45] Date of Patent: Jul. 9, 1991

[54] SAFETY RAZOR APPARATUS

[76] Inventor: Ronald R. Reeves, P.O. Box 16486, Asheville, N.C. 28816

[21] Appl. No.: 553,187

[22] Filed: Jul. 16, 1990

[51] Int. Cl.[5] ..... B26B 19/00; B26B 21/24; B26B 19/04; B26B 21/00

[52] U.S. Cl. ..... 30/86; 30/40; 30/41; 30/47

[58] Field of Search ..... 30/40.2, 41, 41.9, 43.2, 30/43.3, 50, 62, 72, 76, 77, 85, 86, 87, 40, 47

[56] References Cited

U.S. PATENT DOCUMENTS

| | | | |
|---|---|---|---|
| 1,333,306 | 3/1920 | Gill et al. | 30/77 |
| 1,357,863 | 11/1920 | Haggarty | 30/77 |
| 2,053,550 | 9/1936 | Chodaczok | 30/47 |
| 2,442,078 | 5/1948 | Deutsch | 30/47 |
| 3,972,114 | 8/1976 | Chao et al. | 30/41 |
| 4,205,437 | 6/1980 | Chen et al. | 30/41 |
| 4,226,019 | 10/1980 | Sugiyama | 30/41 |
| 4,265,015 | 5/1981 | Asano | 30/41 |
| 4,344,227 | 8/1982 | Chen et al. | 30/41 |
| 4,937,940 | 7/1990 | Mason | 30/41 |

*Primary Examiner*—Douglas D. Watts
*Assistant Examiner*—Paul M. Heyrana, Sr.
*Attorney, Agent, or Firm*—Leon Gilden

[57] ABSTRACT

An apparatus including elongate handle formed with a hollow cavity directed interiorly of the lower end of the handle wherein the hollow cavity includes an internally threaded lower end cooperative with a threaded shaft of a plug member to selectively contain replacement blades within the cavity. The cutting head includes a reciprocatable cleaning plate mounted orthogonally relative to the elongate cutting edges of the spaced cutting blades slidably mounted within the head. Each of the blades includes an elongate cutting edge defined by alternating edge thicknesses to maintain structural integrity of the cutting edge while permitting an efficient and effective shaving operation.

1 Claim, 4 Drawing Sheets

PRIOR ART

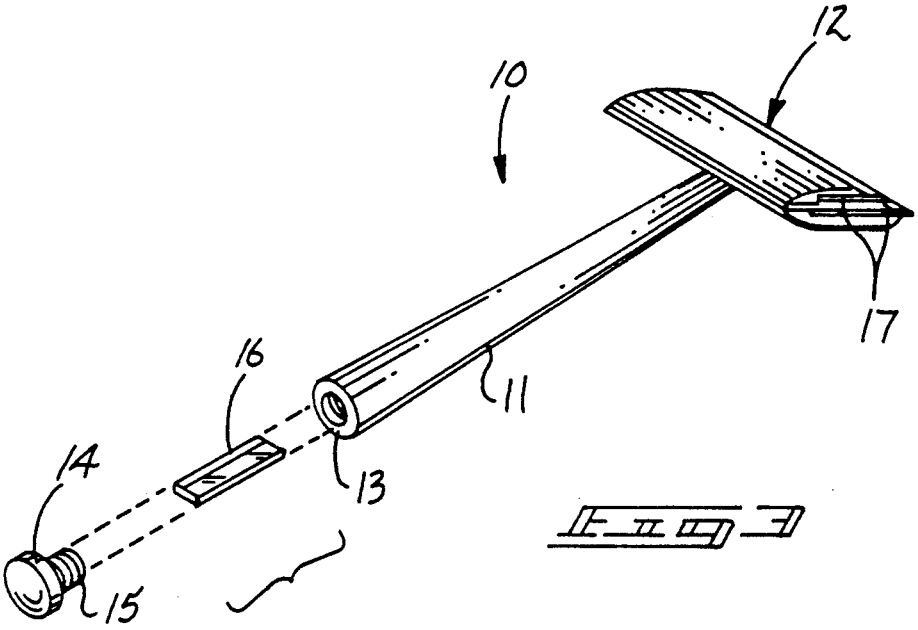
FIG 3
FIG 4
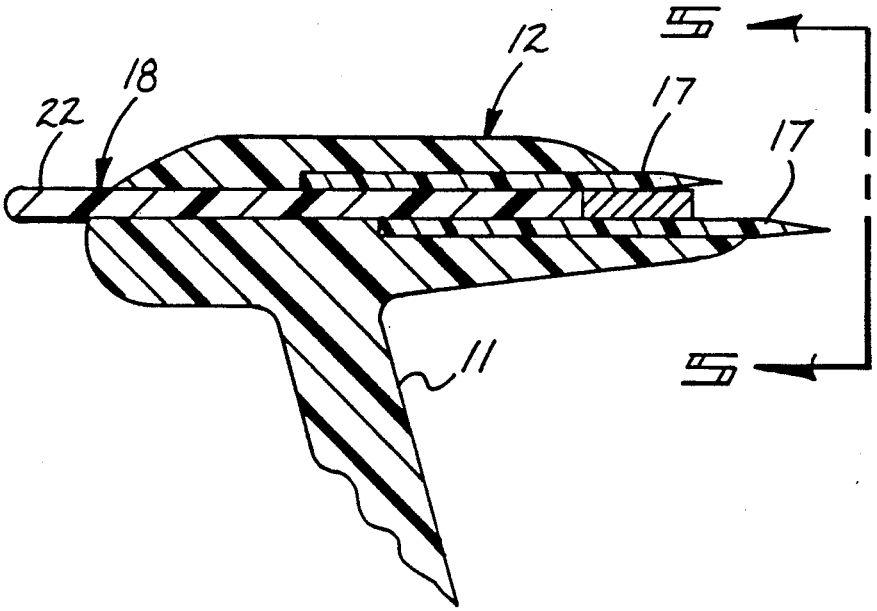

17
17
23
24
24
25
25
25
A
B
B

SAFETY RAZOR APPARATUS

BACKGROUND OF THE INVENTION

1. Field of the Invention

The field of the invention relates to razor apparatus, and more particularly pertains to a new and improved safety razor apparatus wherein the same permits storage of replaceable blades within a hollow cavity of the handle.

2. Description of the Prior Art

Safety razor apparatus of various types has been utilized throughout the prior art. During traveling or recreational camping and the like, individuals utilizing a razor organization finds replacement and or servicing of such organizations inconvenient if not impossible. The instant invention attempts to overcome the deficiencies of the prior art by providing a transportable safety razor apparatus wherein the same permits replacement of blades within the safety head of the razor utilizing blades stored within the handle of the razor while providing an efficient and effective razor construction to enhance and promote longevity of the blades in use. Examples of the prior art include U.S. Pat. No. 4,395,822 to CIAFFONE sets forth a replaceable shaving cartridge for mounting upon a head of a razor wherein the cartridge utilizes a slidable purging fin mounted between spaced blades longitudinally thereof for removing shaving debris therebetween.

U.S. Pat. No. 4,182,031 to CECIL utilizes a razor organization including an elongate recess formed within a longitudinally aligned handle of the organization to receive a replaceable shaving unit therewithin from exteriorly of the handle.

U.S. Pat. No. 4,480,387 to d'ALAYER de COSTEMORE wherein a cleaning device is provided for use with razors including a socket receiving a shaving head permitting directing of fluid to the shaving head to effect cleaning of the head for subsequent use.

U.S. Pat. No. 4,831,730 to CERIER sets forth a safety razor assembly utilizing a stacked plurality of discreet shaving elements of sufficient length to form a handle wherein the elements are removable from an upper end of the stack and repositionable at a lower-most end of the stack to effect constant use of the stack in a shaving procedure.

U.S. Pat. No. 4,776,091 to YAKOU sets forth a razor including a hollow handle receiving a plug member therewithin to store replaceable blade units.

As such, it may be appreciated that there continues to be a need for a new and improved safety razor apparatus which addresses both the problems of ease of use as well as providing extended and convenient prolonged usage of the organization due to storage of substitute blades as well as enhanced blade cleaning structure as well as a cleaning mechanism for the blade and in this respect, the present invention substantially fulfills this need.

SUMMARY OF THE INVENTION

In view of the foregoing disadvantages inherent in the known types of razor apparatus present in the prior art, the present invention provides a new and improved safety razor apparatus wherein the same utilizes spaced parallel blades within a cutting head of a safety razor organization with a reciprocatable plunger mounted to effect cleaning of the blade edges. As such, the general purpose of the present invention, which will be described subsequently in greater detail, is to provide a new and improved safety razor apparatus which has all the advantages of the prior art razor apparatus and none of the disadvantages.

To attain this, the safety razor apparatus of the instant invention includes an apparatus including elongate handle formed with a hollow cavity directed interiorly of the lower end of the handle wherein the hollow cavity includes an internally threaded lower end cooperative with a threaded shaft of a plug member to selectively contain replacement blades within the cavity. The cutting head includes a reciprocatable cleaning plate mounted orthogonally relative to the elongate cutting edges of the spaced cutting blades slidably mounted within the head. Each of the blades includes an elongate cutting edge defined by alternating edge thicknesses to maintain structural integrity of the cutting edge while permitting an efficient and effective shaving operation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety razor apparatus which has all the advantages of the prior art safety razor apparatuses and none of the disadvantages.

It is another object of the present invention to provide a new and improved safety razor apparatus which may be easily and efficiently manufactured and marketed.

It is a further object of the present invention to provide a new and improved safety razor apparatus which is of a durable and reliable construction.

An even further object of the present invention is to provide a new and improved safety razor apparatus which is susceptible of a low cost of manufacture with regard to both materials and labor, and which accordingly is then susceptible of low prices of sale to the consuming public, thereby making such safety razor apparatuses economically available to the buying public.

Still yet another object of the present invention is to provide a new and improved safety razor apparatus which provides in the apparatuses and methods of the prior art some of the advantages thereof, while simultaneously overcoming some of the disadvantages normally associated therewith.

Still another object of the present invention is to provide a new and improved safety razor apparatus which may be compactly stored when not being utilized.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an orthographic cross-sectional view of the shaving head of the instant invention.

FIG. 7 is an isometric illustration of a cutting blade utilized by the instant invention.

DESCRIPTION OF THE PREFERRED EMBODIMENT

Figure 1:
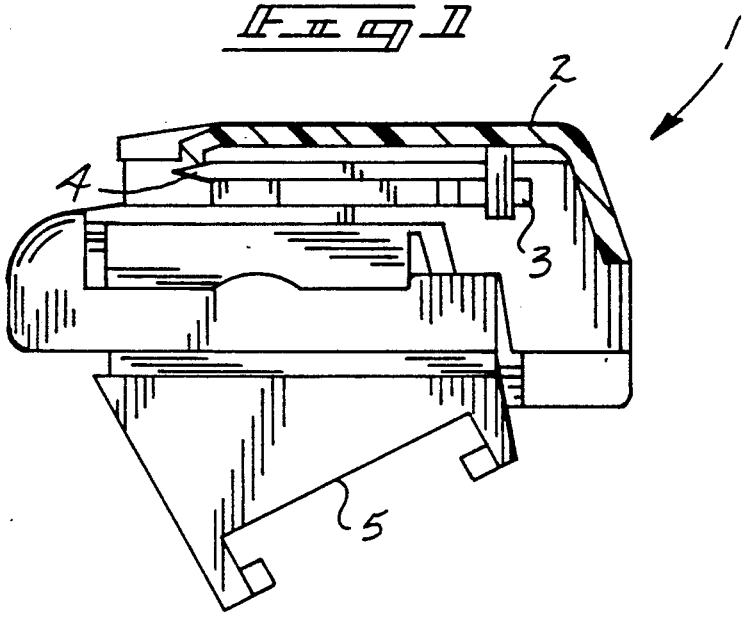
FIG. 1 is an orthographic cross-sectional view of a prior art shaving cartridge utilizing a cleaning plunger mounted for reciprocation longitudinally of the blades.

With reference now to the drawings, and in particular to FIGS. 1 to 8 thereof, a new and improved safety razor apparatus embodying the principles and concepts of the present invention and generally designated by the reference numeral 10 will be described.

Figure 2:
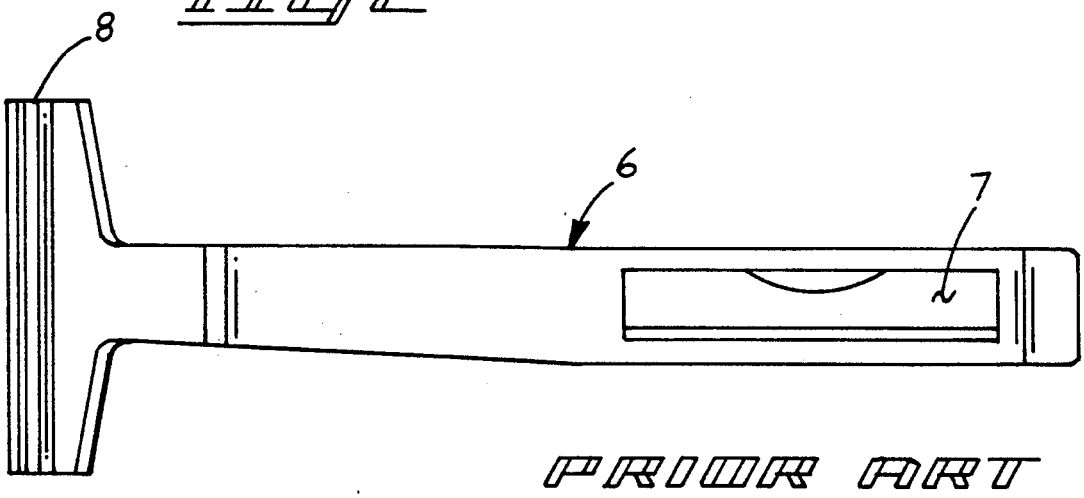
PRIOR ART Fig 2
FIG. 2 is a top orthographic view of a prior art razor apparatus including a recess for storage of additional shaving head.
Figure 5:
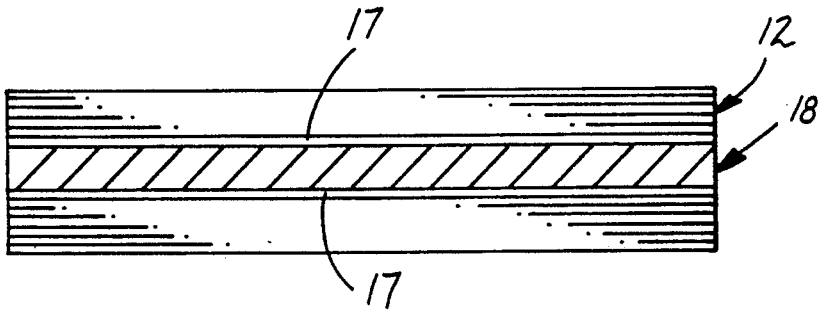
FIG. 5 is an orthographic view taken along the lines 5—5 of FIG. 4 in the direction indicated by the arrows.
Figure 6:
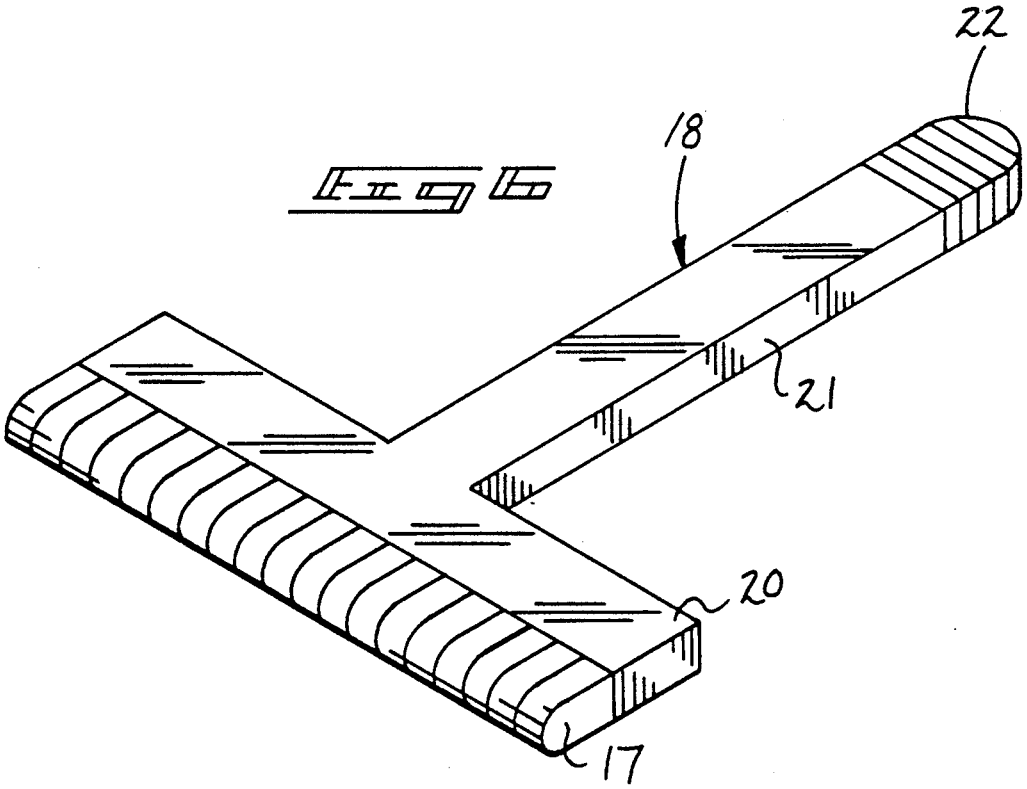
FIG. 6 is an isometric illustration of the cleaning plate utilized by the instant invention.
Figures 8, 11:
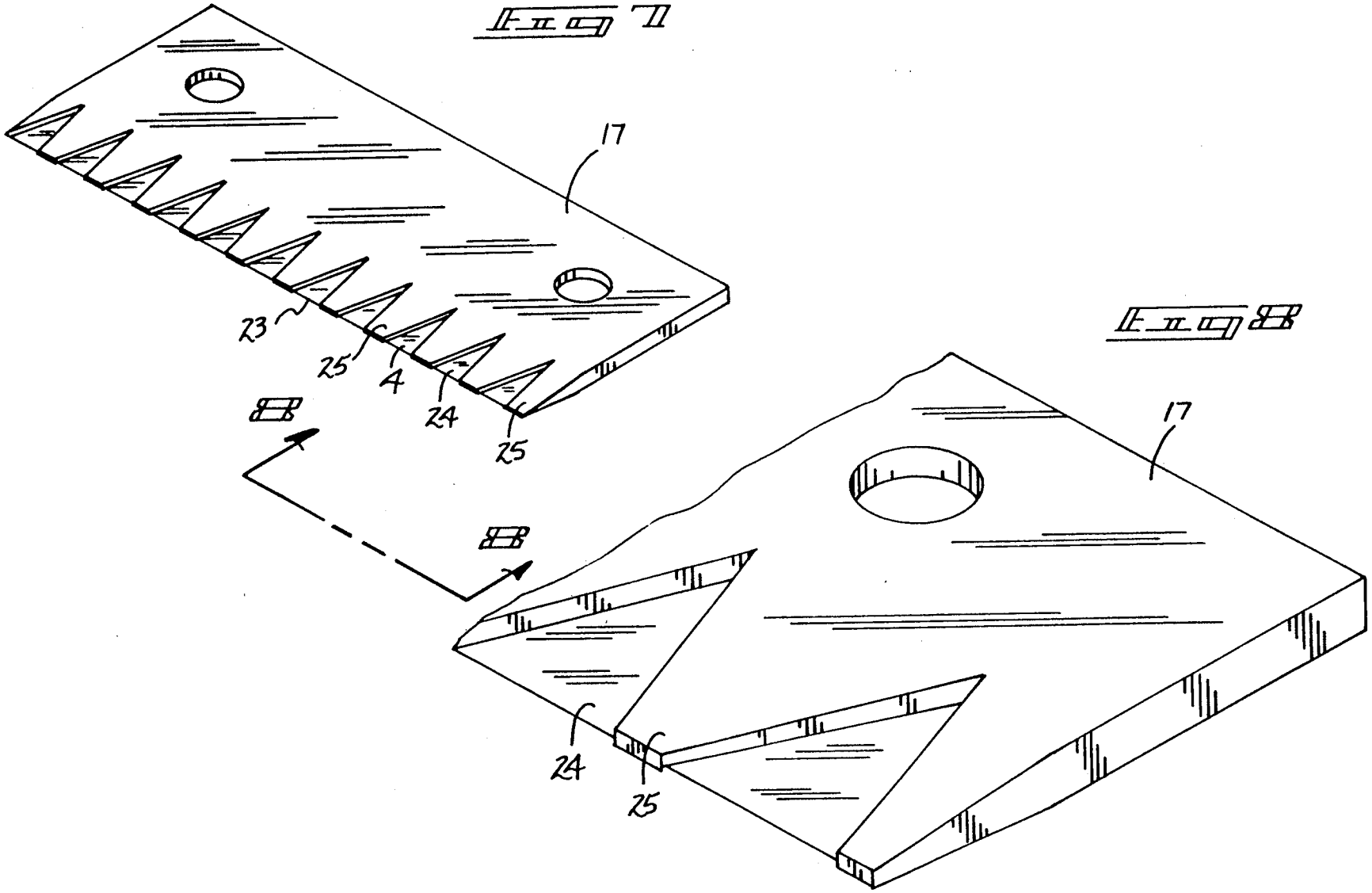
FIG. 8 is an enlarged isometric illustration taken along the lines 8—8 of FIG. 7 in the direction indicated by the arrows.

FIG. 1 illustrates a prior art safety razor cutting head 1 including a cover member 2 overlying a plurality of spaced blades 4 with a reciprocatable cleaning plunger 3 mounted longitudinally of blade structure 4 integrally mounted to a head portion 5 for securement to an associated safety razor as illustrated in U.S. Pat. No. 4,395,822. FIG. 2 illustrates a further prior art razor organization 6 including elongate handle provided with a recess 7 for storage of associated cutting head 8 such as during periods of non-use as set for in U.S. Pat. No. 4,182,031.

More specifically, the safety razor apparatus 10 of the instant invention essentially comprises an elongate longitudinally aligned hollow handle 11 including an elongate hollow cavity formed with a lower-most end of the handle wherein an internally threaded lower end 13 of the cavity receives a stack plurality of replacement blades 16 that are retained selectively for storage within a cavity by use of a plug member 14. The plug member 14 includes an enlarged head defined by a diameter substantially to that of the lower end of the handle 11 to provide a continuous surface with a threaded shaft 15 extending orthogonally from the plug member receivable within the threaded lower end 13. The shaving head 12 of the apparatus is orthogonally and integrally mounted to an upper end of the handle 11 and includes a plurality of spaced parallel cutting blades 17 mounted within complimentary slots within the head 12. A T-shaped cleaning plate is slidably mounted within complimentary elongate slot within the head 12. The cleaning plate 18 is reciprocatably mounted within the head 12 between the blades 17 and arranged orthogonally relative to the elongate cutting edges of the spaced blades 17 rearwardly thereof in a retracted position as illustrated 4. The cleaning plate 18 includes a semi-rigid head member 19 typically formed of leather or other suitable semi-rigid material that is coextensive with the shaving head between the blades 17. The head member 19 is mounted to a support head 20 coextensively thereof with an elongate leg 21 extending rearwardly of the support head 20 mounted orthogonally thereto with a rib projecting tip 22 extending rearwardly of a rear end portion of the head 12 on opposed side of the cutting head from the blades 17. The projecting tip 22 enhances manual grasping and securement of the cleaning plate 18 in use.

FIG. 7 illustrates the cutting blade structure utilized by the instant invention wherein each blade 17 includes an elongate shaving edge 23. The shaving edge 23 is defined by alternating cutting edge thicknesses including wedge shaped fin segments 24 positioned interiorly of the blade 17 between the blade body cutting edge portions 25. The thicker blade cutting edge portions 25 relative to the fin segments 24 provide structural integrity to the blades 17 during use permitting an enhanced efficiency of shaving during a prolonged period. Wedge shaped structural support by the adjacent cutting edge portions 25. Further, the recessed wedge shaped segments 24 provide recessed area defining a relief surface of either side of the segments 24 for accommodating pressure and debris encountered during a shaving procedure.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety razor apparatus comprising in combination, an elongate longitudinally aligned cylindrical handle formed with a cavity therewithin, the cavity formed within the lower-most end portion of the handle and wherein the cavity includes a lowermost internally threaded cavity end, and the internally threaded cavity end supportingly receives a plurality of replacement blades therewithin, and a plug means threadedly received within the cavity end to effect secured storage of the replacement blades within the cavity, and a shaving head orthogonally and integrally mounted to an upper terminal end of the handle, the shaving head including a plurality of spaced cutting blades slidably mounted therewithin, each cutting blade includes a cutting edge positioned forwardly through a forward end of the shaving head, and including a cleaning plate reciprocatably mounted within the shaving head positioned in contiguous relationship between the spaced cutting blades and reciprocatably mounted orthogonally relative to the cutting edges of the cutting blades, and wherein the cleaning plate is defined by a generally "T" shaped member with a forward semi-rigid cleaning head member mounted between the cleaning blades coextensively with the cutting edges for selective cleaning of the cutting between the cutting edges, and further including a rigid support head mounting the semi-rigid head member thereon, and elongate leg extending rearwardly of the support head and integrally mounted thereto this elongated leg projects rearwardly of the shaving head, and wherein the elongate leg includes a ribbed projecting tip projecting exteriorly of the shaving head to enhance manual grasping of the elongate leg for reciprocation of elongate leg relative to the cutting blades, and wherein each cutting edge of each cutting blade is defined by alternating segments of alternating thickness, and wherein the alternating segments include first wedge shaped thinned segments mounted between cutting edge portions of a predetermined thickness greater than a thickness defined by the thinned segments, and wherein each of the first wedge shaped thinned segments is defined by a triangular configuration including a base edge coextensive with the cutting edge, and each thinned segment defines a recessed area on each side surface of the segment between the cutting edge portions to accommodate pressure and debris encountered during a shaving procedure.

* * * * *